US005522434A

United States Patent [19]

Lindblom

[11] Patent Number: 5,522,434

[45] Date of Patent: Jun. 4, 1996

[54] APPARATUS FOR CONTROLLING A DRIVE MOTOR IN A WEAVING MACHINE

[75] Inventor: Bo Lindblom, Osby, Sweden

[73] Assignee: Texo AB, Almhult, Sweden

[21] Appl. No.: 321,623

[22] Filed: Oct. 12, 1994

[30] Foreign Application Priority Data

Oct. 18, 1993 [SE] Sweden ..... 9303420

[51] Int. Cl.[6] ..... D03D 51/00

[52] U.S. Cl. ..... 139/1 E; 318/140; 318/151

[58] Field of Search ..... 318/140, 151, 318/376; 139/1 E

[56] References Cited

U.S. PATENT DOCUMENTS

| | | | |
|---|---|---|---|
| 4,609,858 | 9/1986 | Sugita et al. | 318/1 E |
| 5,099,186 | 3/1992 | Rippel et al. | 318/376 X |
| 5,345,154 | 9/1994 | King | 318/140 X |

*Primary Examiner*—Andy Falik
*Attorney, Agent, or Firm*—Pollock, Vande Sande & Priddy

[57] ABSTRACT

An apparatus and method for actuating a drive member in a weaving machine comprises a drive unit, connected to a power supply network, for controllably rotating the drive member. The drive unit includes a direct-current operated unit selectively operable both as a direct-current motor and as a direct-current generator. A control unit is provided for generating and supplying to the drive unit at least one control signal for substantially continuously controlling the angular velocity of the drive member in each of its revolutions. According to the present method the control signal further selectively controls the drive unit to operate in first modes where the drive unit operates as a direct-current motor and in second modes where the drive unit operates as a direct-current generator. The drive unit is selectively operable over predetermined portions of a cycle of operation to function either as a motor energized by the power supply network or as a direct-current generator to feed energy back to the power supply network.

19 Claims, 2 Drawing Sheets

APPARATUS FOR CONTROLLING A DRIVE MOTOR IN A WEAVING MACHINE

TECHNICAL FIELD

The present invention relates to a device associated with a drive member or drive axle in a weaving machine. This invention is utilized preferably in a weaving machine for larger fabric widths, for example, 1–30 meter fabric widths. The drive member is rotatable by means of a drive unit which is connected to a power supply network and which receives a control signal or control signals from a control unit. The present invention also relates to a process for making such a device.

BACKGROUND OF THE INVENTION

In weaving machines for wire gauze and similar weaving material, large fabric widths, for example, fabric widths of up to 30 meters, are woven. Examples of such weaving machines are those made by TEXO AB, Sweden, and those sold on the open market under their specification.

Hitherto, proposals have regularly been made for weaving machine designs having mechanical actuating and transmission members driven from a utilized driving member/drive axle, which in turn actuated those parts in the weaving machine (reed members, shaft frames, beams, and the like) which perform the weaving machine functions. It has also been proposed to drive certain operating parts with electrical devices, for example, AC-servos. Nevertheless, the basic premise has been that the weaving machine should predominantly comprise and be driven by mechanical transmissions, for example, gear bearings, eccentrics, and the like.

There is an acute need to produce more cost effective weaving machines having a mechanically simpler construction to achieve simpler handling and installation procedures. The present invention aims, among other things, to solve this problem. Also, in the present type of weaving machines, there is a need to increase the weaving speed. Current weaving machines are able to operate, for example, at about 30 picks/min. while maintaining the required quality of the woven material. In an attempt to increase the weaving speed without sacrificing weaving quality, weaving speed increases are discussed of about 10% of the weaving speed. There is a need however to be able to increase weaving speed more substantially, for example, by 25–40% as compared with the speeds obtained in current, mechanically built weaving machines, without any sacrifice in quality. The present invention also aims to solve this problem. According to tests, the weaving machine of the present invention offers pick speeds of up to 50 picks/min.

In the present type of weaving, there is a need, in the production of wire gauze, cloth, and the like to utilize, for example, various types, thicknesses, and the like of weft threads. This requires that the pick speed or weaving machine speed be varied as the weaving progresses. It is necessary to be able to vary, for example, the butting or beating speed, shaft frame motions, and the like. In a mechanical arrangement, one would then have started from the lowest motion pattern in the weaving machine, resulting in the weaving machine, which for certain thread types and thread thicknesses in the fabric, cloth, and the like, operates more slowly than it actually needs to for other types, thicknesses, and the like of the thread. There is therefore a need, during ongoing weaving of one and the same length of wire gauze or fabric, to be able to alter the weaving speed in a simple manner. The instant invention also solves this problem.

The same weaving machine should be able to be utilized for weaving different wire gauze types, or equivalent, requiring different weaving speeds. In a mechanical arrangement, gearwheels in clutch housings are changed in order to achieve, for example, different eccentric functions. This is a relatively awkward procedure and there is a need for more simple execution of the conversion. The present invention solves this problem.

According to the inventive concept, the driving of the main axle, or equivalent, of the weaving machine is accomplished by use of a direct-current arrangement. One or more direct-current operated units should be capable of operating as direct-current motor(s) and direct-current generator(s) and the unit or units should be driven from a power supply network to which electrical energy should also be able to be fed back. The present invention thereby solves the problem of the attainment of a small power feedback in otherwise large power consumption weaving machines.

The connections of the direct-current motor and direct-current generator functions to the power supply network should be realized without too great an interference in, and knowledge of the power supply network. The power supply network should be constituted by or connected to the public mains. The invention solves this problem also and proposes that, for the connection of the control systems between the motor and generator functions and the like, use should be made of well established components available on the market.

In order to obtain an expedient control function, it is important to utilize control signals having certain characteristics. The present invention also solves this problem and provides, among other things, that sinusoidal control signals be applied in and to the control system. The problem is solved with the adaptation of the sinusoidal form to the motions of the weaving machine. The instant invention provides that a sinusoidal form should be utilized in displaced form.

According to the inventive concept, the drive member should sometimes be accelerated and sometimes be retarded during a respective turn of the drive member, with the aid of the motor and generator functions. It is important to be able to obtain motion patterns for the shaft frames and reed members, taking into account thread material, patterns, and so forth. The present invention also solves this problem and provides that the butting speed be varied form one thread to another, from one setting to another, and the like. The motions of the shaft frames should also be able to be influenced, as well as the motions of the weaving machine in connection with the shot region.

Large forces are developed in the weaving machine due to the large masses involved. Masses of about 2000 kg/meter of weaving machine width are herein discussed. The butting force is large and needs to be effectively managed. The present invention also solves this problem and provides that the counter-force from the weave, upon abuttal or beating up, should be taken in hand and should make an active or positive contribution to the retardation path by being braked on the electrical network.

In addition, forces are needed to start lifting the frames in the butting or beating position. This should be carried out, from an energy viewpoint, in an economical manner. The present invention also solves this problem and utilizes the kinetic energy in the rotating generator unit in the lifting function.

In this type of weaving machine, it is important to be able to arrange for an emergency stop, a so-called "protector stop" which will prevent, for example, any shot in the weave. The instant invention also solves this problem since, in an emergency stop, the energy is braked on the electrical network.

SUMMARY OF THE INVENTION

The device of the present invention aims to solve, among other things, the above-mentioned problems and is characterized in that the drive unit actuates the drive member and generates for this a varied rotation during a respective turn of the drive member. The varied rotation is preferably conducted without any substantial stand-still during the rotation. In order to realize the varying rotation during a respective turn, a direct-current operated unit is included, which, in response to a control signal or control signals, operates either as a direct-current motor or as a direct-current generator. The direct-current motor and direct-current generator functions respectively accelerate and retard the drive member during its respective turn. The working phase or phases of the unit as a direct-current motor are realized with energy from the power supply network. When the unit operates as a direct-current generator, it feeds the energy back to the power supply network.

As set forth above, the device of the present invention comprises a control unit which, in a preferred embodiment, delivers control signals of a substantially sinusoidal character. The control unit can deliver control signals of different appearance in sinusoidal form. In this way, different rotation characteristics are achieved for the drive member or drive axle during a respective rotation turn. Moreover, a first control signal can thus exhibit a first sinusoidal form, which produces a first average rotation or angular velocity of the drive member. A second sinusoidal form can produce a second average rotation or average angular velocity, and the like.

In a further embodiment, a transmitter member is utilized, which returns the actual value of the drive member to the control unit. The latter uses the actual-value signal, together with an adjusted signal, to produce a target-value signal, which can be realized in a known manner. The turning speed or angular velocity and/or turning or angle characteristics of the drive member are arranged essentially with infinitely variable design or having narrow step intervals.

In one embodiment, the drive unit operates at minimum angular velocities and maximum angular velocities. The angular speeds can be between 1000 r.p.m. and 3500 r.p.m. respectively. The minimum velocity occurs, in one embodiment, in a first position of the drive member corresponding to the operating position in which a shuttle leaves its box or mounting and is pushed from one side to the other in the loom. Once this minimum velocity is achieved, the drive member is accelerated, with the unit operating as a direct-current motor, towards a second rotation position for the drive member, corresponding to an operating position before an abutting stop for a reed member. At the end of the acceleration distance, the drive member assumes the maximum angular velocity. The unit is thereafter switched over to function as a direct-current generator, a retardation path being engendered from the latter position to the former position (the shuttle position). The butting or beating position for the reed is positioned at the start of the retardation distance, for example, at about 360° for the drive member.

The butting or beating force, via the reed member, is introduced to the drive member as a propulsion force for the generator function, which, according to the above, is slowed down in the power supply network. Substantial parts of the kinetic energy of the reed member are thus converted into electrical energy.

In one embodiment, the direct-current operated unit comprises two or more units, which are arranged relative to the drive member, preferably at the ends of the drive member or drive axle. A first drive unit can operate as a master unit, while another or other part-unit(s) operate(s) as a slave unit or slave units. In one embodiment, the control unit may comprise a microcomputer or personal computer unit, by means of which sinusoidal control signals are generated.

The process according to the present invention is mainly characterized in that the drive unit is controlled by the control unit, preferably by means of control signals of sinusoidal character generated in the control unit. During a respective turn of the drive member, this is rotated by the drive unit at varied rotational speed or angular velocity (accelerated or retarded respectively). This occurs because the drive unit, which is constituted by a direct-current operated unit, is controlled to operate either as a direct-current motor or as a direct-current generator. The direct-current motor is supplied with energy from the power supply network and electrical energy generated by the direct-current generator is fed back to the power supply network.

In one embodiment, different control signals of sinusoidal shape are generated and are supplied to the drive unit in order to bring about different rotational speed or angular velocity characteristics and speeds for the drive member of the weaving machine. In this way, different butting or beating speeds can be allocated to the reed member or members in order to meet the need for varied butting speed with different types of weaving threads or different thicknesses of warp threads. The drive member is controlled to rotate without stoppage or standstill during a respective turn and is accelerated and retarded, by the direct-current operated unit, between a lower angular velocity and a higher angular velocity. Minimum and maximum velocities can lie within the rotational range of from about 1000 r.p.m. to about 3500 r.p.m.

Due to these features, several advantages are obtained. With the same or similar control signal, the speed of the direct-current motor and the direct-current generator function can be changed and a switchover between the motor and generator functions can be realized. The control signal amplitude can range between ±10 Volts. By setting an amplitude value, a first average rotational or angular velocity can be achieved for a respective turn and, with a second amplitude value, another average rotational or angular velocity is achieved, and the like. Using the basic sinusoidal form, rotational speed characteristics can also be determined. Two direct-current motors/generators can be utilized. Conventional aggregates which are sold on the open market can be utilized. The size of a 20-meter weaving machine is, for example, an aggregate which is driven at 150–200 A, at 440 Volt and 60 Hz in the direct-current motor mode and returns 150–200 A in its generator mode. The total power feedback is relatively small, about 1 kW. The generator returns reactive power in cosine form (motor position cosine 0.92 and, in generator position, cosine 0.74).

As a result of rotation without standstill, less energy needs to be braked as compared to the case with standstill machines in which a large quantity of energy is braked using a braking member (Ortlingshausen) and in which, because of this, large swings occur in the shaft frames and, moreover, the weaving machine vibrates.

Emergency braking (protector stop), using a DC-motor operating as a generator, is effective. At a weaving machine speed of 50 picks/min., the stop value can be set at 245°.

The arrangement can be made so that the machine comes to a halt at 268°. Upon a stop signal, the control signals of the machine are controlled directly down to zero and all energy is braked on the power supply network.

Using the control signal, the drive in the weaving machine can be adjusted, and the weaving machine can follow the control signal with great accuracy, irrespective of the stress imposed by the weaving machine. The "eccentric" function in the weaving machine can easily be imitated by the control functions and control signals.

By "displacement" of the sinusoidal signal, it is possible to compensate for the mechanical imbalance in the machine and to achieve maximum efficiency in the acceleration and retardation phases.

BRIEF DESCRIPTION OF THE DRAWINGS

A device and a process according to the present invention are to be described below with simultaneous reference to the accompanying drawings, in which.

DETAILED DESCRIPTION OF THE PREFERRED EMBODIMENT

Figure 1:
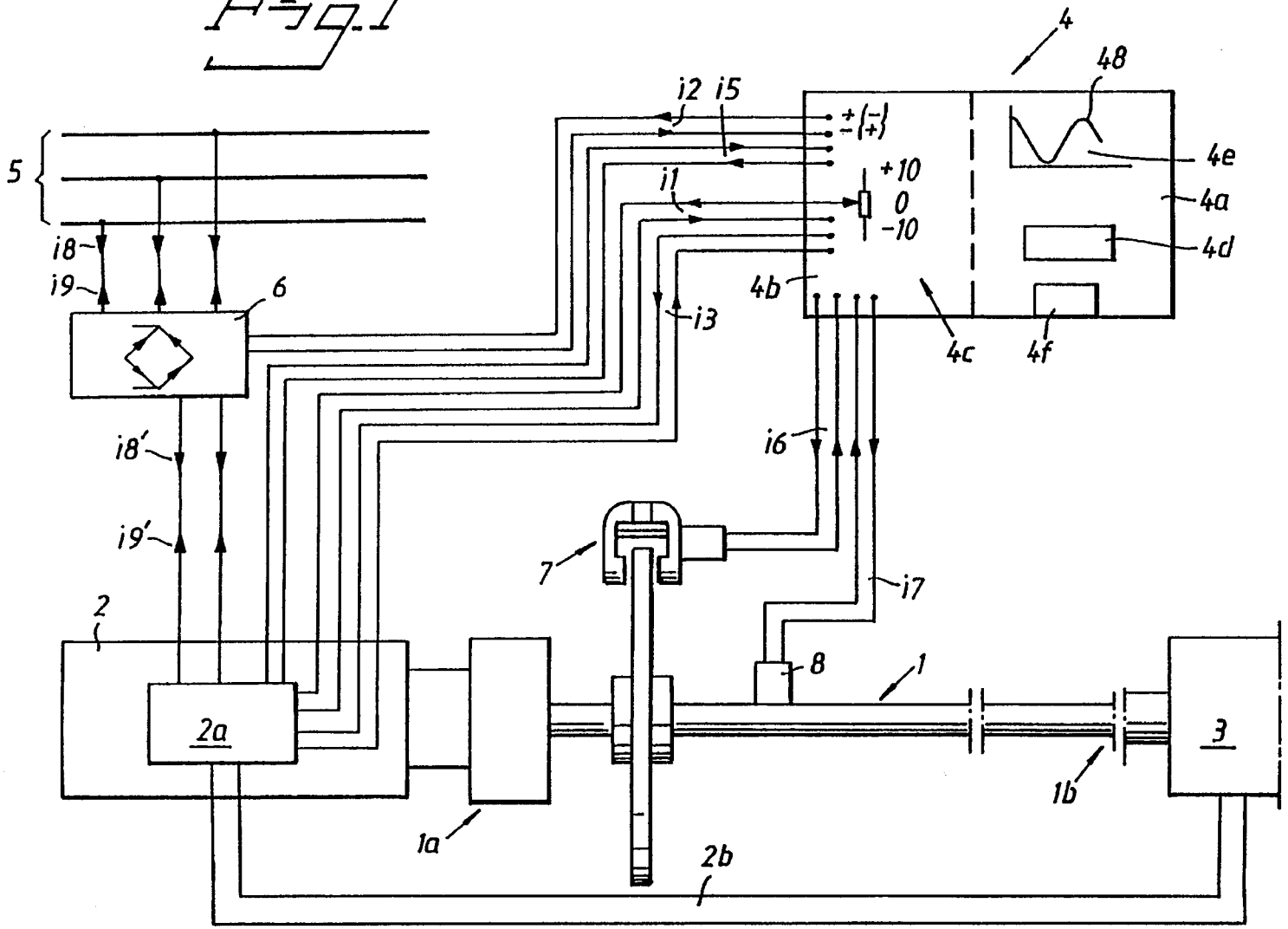
FIG. 1 shows, in a block diagram and basic diagram form, a drive member (the drive or transmission axle) in a weaving machine or drive unit for the latter, the drive unit being connected to the power supply network and controlled by a control unit.

In FIG. 1, a drive member 1 is shown, which forms part of a weaving machine. The drive member can be constituted by the main drive axle or transmission axle of the machine. The drive member 1 is driven by direct-current operated first and second units 2, 3 each disposed at respectively opposite ends 1*a*, 1*b* of the drive member. The units 2, 3 are of the type which can operate both as a direct-current motor and as a direct-current generator depending upon magnetic reversals. Examples of such units are direct-current motors of the LENZE make (150 Amp, 440 V, 60 Hz). By selectively operating either as a motor or as a generator, the respective unit can provide acceleration and retardation modes to produce varied angular velocity in a respective turn of the drive member. The acceleration and retardation modes are determined by a unit 4, which comprises a personal computer (microcomputer) 4*a* and a computing part 4*b* for the generation of a control signal 11 applied to a unit 2*a*, of a respective unit 2, 3. The units 2, 3, when operating as direct-current motors, are supplied with energy from a power supply network 5 of the alternating-current type, which network can be connected to or may form the public mains in a known manner.

The units 2, 3, when operating as generators, feed energy back to the network 5. Detailed connections in this instance are shown only for the unit 2. The unit 3 has an equivalent connection to the network. The connection is realized via a current converter unit 6 (four-quadrant) of a known type, for example, of the LENZE make.

When the units 2, 3 are coupled as motors, energy is fed from the network 5 to the units via the current converter unit. This is switched over to enable electrical energy to be fed to the network from the units 2, 3, when these operate as generators. The switchover is brought about by means of the signal i2 from the control unit. The demagnetization function is realized by means of signals i3 generated by the control unit 4.

The unit 4 is also arranged upon a detection of, for example, a thread-breakage condition or positional detection for the shuttle function, and the like, to generate an emergency stop signal i5. The emergency stop signal commands the motor down to 0 Volt, which means that the motor immediately starts operating as a generator and the kinetic energy present within the system will be braked, with the generator function, on the power supply network 5.

Each unit 2, 3 is provided with a disk brake member 7 arranged to detain the motor/generator 2 and 3 respectively in an attained stop position. The signal for the disk brake member is denoted by i6 and is also emitted from the control unit 4.

To the drive member 1 there is connected a transmitter 8 or tachometer, which detects the actual rotation of the drive member and supplies the detected information to the unit 4. The returned signal is indicated by i7, which thus constitutes an actual-value signal. The control unit 4 is constructed with a member 4*c* to adjust different average rotations of the drive member 1. There is therefore an adjusting member present, which is applied by the operator in a known manner. This adjustment can be carried out by setting a resistance of ±10 Volts. The computing unit 4*b* generates, upon the actual-value signal and adjustment, the target-value signal i1 for equipment of the unit 2 and 3, respectively. Such computations and signal generations can be conducted in a known manner.

By means of the personal computer or microcomputer 4*a*, the curve character for the signal i1 can additionally be generated. A terminal part is denoted by 4*d* and a display part by 4*e*. The personal computer creates the new curve in a known manner, which is shown graphically on the screen. The values for the curve are similarly shown or indicated on the screen. A print-out can be produced on the printer 4*f*. Saved files are shown and curves can be obtained from a floppy disk. This curve also can be saved. The curve is transferred to processing system Omron™, which can be placed in the control unit 4 of the unit 2*a*. A change to a low speed-motion can be carried out, whereafter the curve can be created. Such a curve is indicated by the figure. The feed direction/current from the network, in the direct-current motor mode, is shown by i8 and i8', and to the network, in the generator mode, by i9 and i9', respectively.

The units 2, 3 have mutually synchronized movements in a known manner. The unit 2 operates as a master unit and the unit 3 as a slave unit. The synchronization is indicated by a lead 2*b*.

Figure 2:
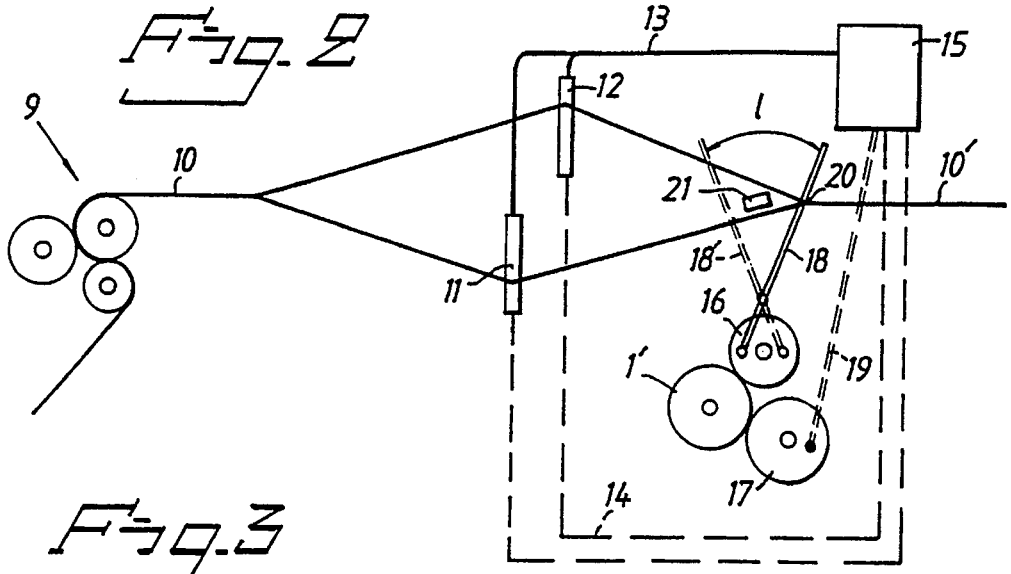
FIG. 2 shows from the side, in basic diagram form, a shaft frame, reed and shuttle member, as well as the actuation of these parts by the drive member.

In FIG. 2 there is shown, in basic representation, a weaving machine of the type which utilizes the present invention. A beam arrangement for the warp thread 9 and the warp threads 10 are shown, along with the shaft frame system comprising shaft frames 11 and 12. The position of the shaft frames is assigned in a known manner, using a pull rod arrangement 13 and 14. A unit 15 executes the pull-rod motions. The transmission or drive axle 1' is shown in FIG. 1. The motion of the drive axle is transmitted to circular wheels 16 and 17 for executing the motions for a reed member 18 and for unit 15 executing the pull-rod motions. The transmission 19 is between the wheel 17 and the unit 15. The motions in question can be performed or transmitted in a known manner. The reed member is eccentrically connected to the wheel 16 in the illustrated cross section. The reed member assumes, in FIG. 2, its two end positions, the end position with the unbroken line 18 indicates the butting or beating position of the reed member against the weave edge 20 and the dashed line 18' indicates the position in which a shot is realized. The shuttle function is shown by 21. The reed member 18, 18' moves a distance 1 and, according to the invention, it can move at different speeds along this distance and can have reduced speeds at end positions with greater speed between the end positions.

Figure 3:
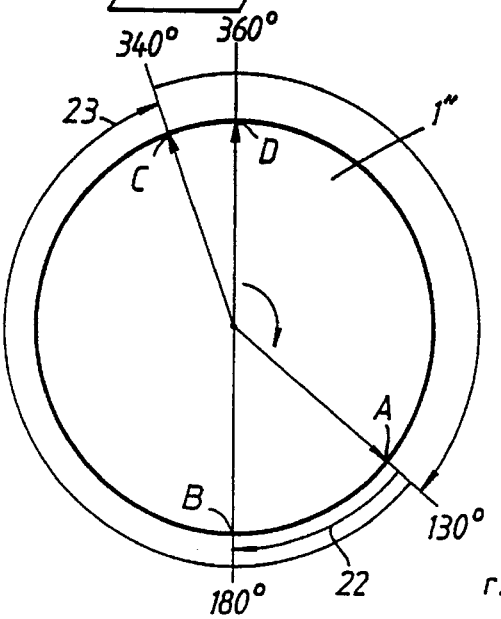
FIG. 3 shows, in a cross-section of the drive member, the acceleration and retardation paths for the attainment of a varied angular velocity.

In FIG. 3, the different acceleration and retardation paths for the drive member 1" are shown in cross-sectional view. The angular velocity is lowest at 130°. This position is indicated in the figure by A. The shuttle motion is executed between the position A and a position B corresponding to 180°. The range of the shuttle motion is shown in the figure by the arrow 22. From the position A, the drive member is accelerated by the drive unit over an acceleration distance which is indicated by the arrow 23. The acceleration proceeds to a position C at 340°. After this position, the respective unit 2, 3 according to FIG. 1 is remagnetized and the units start operating as generators. This produces a retardation path for the drive member, which starts from the position C and proceeds to the position A, and so on. Abuttal or beating up occurs at a position D, which corresponds to 360°. The angular velocities of the drive member can be substantially varied during a respective turn in accordance with the above.

Figure 4:
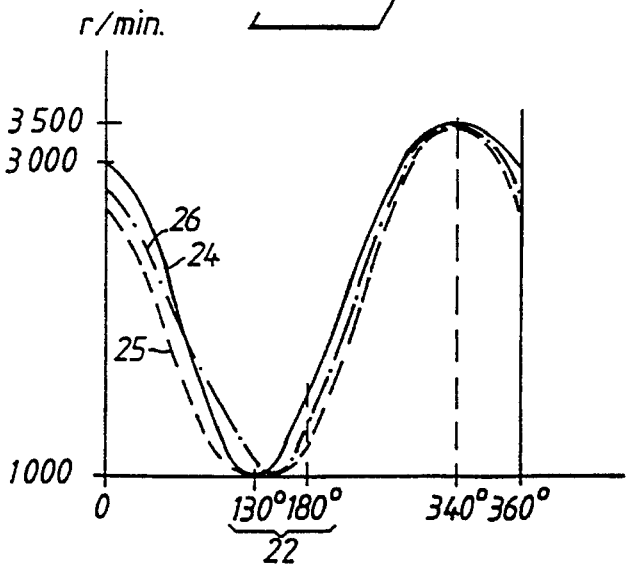
FIG. 4 shows the acceleration and retardation path curves during a respective turn (360°) of the drive member, as well as the appearance of control signals for the attainment of the acceleration and retardation curves.

FIG. 4 shows, by way of an unbroken curve 24, the retardation and acceleration paths for the drive member according to FIG. 3. The highest angular velocity is indicated by the rotational speed at the end of the acceleration path, that is at 340° standing at 3500 r.p.m. The angular velocity or rotation is at its lowest at 130° and assumes a value of about 1000 r.p.m. The angular velocity or rotation, upon abuttal, is about 3000 r.p.m. The curve 24 can in principle be displaced such that the maximum and minimum values occur at other degree values, for example, see the dashed curve 25, which shows that variation of the speed upon abuttal can assume other values. In addition, the dash-dot line 26 shows that the minimum speed also can be arranged to occur at a degree value other than 130°.

Curves 24, 25, 26 can also be considered to symbolize the appearance of the signal il from the control unit 4. (See FIG. 1).

The present invention is not limited to the embodiment shown by way of example above, but can be subject to modifications within the scope of the subsequent patent claims and the inventive concept. The control unit 4 and its principal parts 4*a*, 4*b* can be given suitable placements in the weaving machine equipment. The parts 4*a* and 4*b* can also be spaced apart from each other.

I claim:

1. Apparatus for controlling the operation of a drive member actuating a reed member in a weaving machine, comprising:

a drive unit, connected to a power supply network, for controllably rotating the drive member;

said drive unit including a) a direct-current operated unit selectively operable both as a direct-current motor and as a direct-current generator, and b) means for effecting the selective operation;

a control unit for generating and supplying to said drive unit at least one control signal for substantially continuously controlling the angular velocity of the drive member in each of its revolutions, said at least one control signal farther selectively controlling said drive unit to operate in first modes wherein said drive unit operates as said direct-current motor and in second modes wherein said drive unit operates as said direct-current generator, whereby said drive unit is selectively operable over predetermined portions of a cycle of operation to function either as a motor energized by the power supply network or as a direct-current generator to feed energy back to the power supply network.

2. An apparatus according to claim 1, wherein said control unit includes a computer unit for generating said at least one control signal in a substantially sinusoidal waveform.

3. An apparatus according to claim 2, wherein said computer unit includes means for generating control signals of different waveforms for obtaining different angular velocity characteristics for said drive unit corresponding to the different waveforms.

4. An apparatus according to claim 2, wherein said at least one control signal includes a first signal having a first sinusoidal form for producing a first average rotational speed of said drive member and a second signal having a second sinusoidal form for producing a second average rotational speed of said drive member.

5. An apparatus according to claim 1, wherein said at least one control signal generated by said control unit and supplied to said drive unit includes at least a first control signal for setting a first average rotational speed for said drive unit and thereby said drive member, and a second control signal for setting a second average rotational speed.

6. An apparatus according to claim 1, further including a transmitter member connected to said drive member for detecting actual rotational speed of the drive member and for supplying detected signals to said control unit as actual-value signals.

7. An apparatus according to claim 6 wherein said control unit further includes an adjustment unit for adjusting said actual-value signals and a computing unit for generating target-value signals for said drive unit based on said actual-value signals and said adjustment signals.

8. An apparatus according to claim 1, wherein said control unit of said apparatus generates a first control signal for controlling said drive member to reach a minimum rotational speed at a first position in timed relation to the instant when a shuttle of said weaving machine leaves its box or mounting and runs from one side to the other in the weaving machine.

9. An apparatus according to claim 8, wherein said direct-current operated unit is controlled by said control unit to accelerate said drive member from said minimum rotational speed at said first position toward a second position corresponding to another rotational speed which is in timed relation to the instant of an abutting stop for said reed member, and wherein said control signal of said control unit causes switchover of the operation of said direct-current operated unit to said direct-current generator mode for retardation of said drive member between said second position and said first position with the minimum rotational speed or minimum angular velocity, the butting position for the reed member coinciding with the beginning of the retardation for the drive member.

10. An apparatus according to claim 1, wherein said reed member introduces butting force to the drive member as a propulsion force for the generator mode, whereby substantial parts of the kinetic energy of the reed member are converted into electrical energy supplied to the supply network.

11. An apparatus according to claim 1, wherein said control unit generates a second control signal which depending on a function of said weaving machine, controls switchover of the direct-current operated unit between its direct-current motor mode and direct-current generator mode.

12. An apparatus according to claim 1, wherein the direct-current operated unit comprises two-part drive units disposed each at one end of said drive member, and wherein a first drive unit operates as a master unit and another operates as a slave unit.

13. An apparatus as claimed in claim 1, wherein said means for effecting the selective operation comprise a current converter for converting alternating current to direct current during said first modes and converting direct current to alternating current during said second modes.

14. In a weaving machine, a method for controlling the operation of a drive member actuating a reed member, said method comprising the steps of:

connecting a drive unit to a power supply network to controllably rotate the drive member which includes a direct-current operated unit constructed to operate both as a direct-current motor to operate as a direct-current generator;

generating and supplying to said drive unit at least one control signal to control continuously the angular velocity of the drive member in each of its revolutions, and to selectively also control said drive unit to operate in first modes in which said drive unit operates as a direct-current motor and alternatively in second modes in which said drive unit operates as a direct-current generator, whereby said drive unit it selectively operable to function either as a motor energized by the power supply network or as a direct-current generator to feed energy back to the power supply network.

15. An apparatus as claimed in claim 1, wherein said at least one control signal has different sinusoidal forms and is generated by a computer unit included in said control unit, said different forms corresponding to different angular velocity for the drive member and different butting speeds of the reed member, when weaving with weaving thread having different characteristics.

16. A method according to claim 14, wherein the drive member is controlled by said at least one control signal to rotate at varied angular velocities during its respective revolution, substantially without stopping during said revolution and by operation of said first and second modes to be selectively accelerated and retarded, by the direct-current operated unit, between a lower angular velocity, and a higher angular velocity.

17. A method according to claim 16, wherein the higher angular velocity exceeds the lower angular velocity by about 3 to 4 times.

18. A method according to claim 14, further including steps of detecting actual rotational speed of the drive member by a detector and supplying detected signals as actual value signals to the control unit.

19. A method according to claim 18, further including adjusting said actual-value signals in an adjustment unit of said control unit and generating target value signals based on said actual-value signals and adjustment signals.

* * * * *